US008495966B2

(12) United States Patent
Lazarevic

(10) Patent No.: US 8,495,966 B2
(45) **Date of Patent: *Jul. 30, 2013**

(54) AMPHIBIOUS BOATS, CANOES AND KAYAKS

(76) Inventor: Ranko Lazarevic, Mississauga (CA)

( * ) Notice: Subject to any disclaimer, the term of this patent is extended or adjusted under 35 U.S.C. 154(b) by 0 days.

This patent is subject to a terminal disclaimer.

(21) Appl. No.: 13/307,783

(22) Filed: Nov. 30, 2011

(65) Prior Publication Data

US 2012/0137952 A1 Jun. 7, 2012

Related U.S. Application Data

(63) Continuation of application No. 12/379,271, filed on Feb. 18, 2009, now Pat. No. 8,091,501.

(30) Foreign Application Priority Data

Feb. 12, 2009 (CA) ..... 2653882

(51) Int. Cl.
*B63B 21/64* (2006.01)

(52) U.S. Cl.
USPC ..... 114/344

(58) Field of Classification Search
USPC ..... 114/344; 440/12.5
See application file for complete search history.

(56) References Cited

U.S. PATENT DOCUMENTS

| | | | |
|---|---|---|---|
| 1,376,496 | A | 5/1921 | Woodruff |
| 2,042,598 | A | 6/1936 | Harvey |
| 2,831,203 | A | 4/1958 | Kanarr |
| 3,095,585 | A | 7/1963 | Thomas |
| 3,370,309 | A | 2/1968 | Fredelake |
| 3,858,260 | A | 1/1975 | Hanser |
| 4,180,881 | A | 1/1980 | Speranza |
| 4,318,632 | A | 3/1982 | Fortmeyer |
| 4,392,665 | A | 7/1983 | Miller et al. |
| 4,515,102 | A | 5/1985 | Kury |
| 4,579,357 | A | 4/1986 | Webster |
| 4,706,983 | A | 11/1987 | Griswold |
| 5,197,405 | A | 3/1993 | King |
| 5,261,680 | A | 11/1993 | Freitus et al. |
| 5,353,733 | A | 10/1994 | Evans |
| 5,491,544 | A | 2/1996 | Kenin et al. |
| 5,573,259 | A | 11/1996 | Castillo et al. |
| 5,941,544 | A | 8/1999 | Fiedler |
| 6,189,478 | B1 | 2/2001 | Myers et al. |
| 6,540,245 | B1 | 4/2003 | Shankle et al. |
| 6,568,344 | B2 | 5/2003 | Burlet |
| 7,243,928 | B2 | 7/2007 | Singer |
| 8,091,501 | B2 | 1/2012 | Lazarevic |

(Continued)

FOREIGN PATENT DOCUMENTS

| | | |
|---|---|---|
| CA | 2152096 | 5/1996 |
| CA | 100377 | 10/2003 |

(Continued)

*Primary Examiner* — Stephen Avila
(74) *Attorney, Agent, or Firm* — Fitch Even Tabin & Flannery LLP

(57) ABSTRACT

An amphibious small boat, including rowing/fishing/motor/sailing boats, canoes and kayaks has a removable, retractable wheeled undercarriage enabling the craft to be trailered or managed singlehandedly on the ground; or the undercarriage retracted inboard. The canoe and kayak undercarriage is easily removed. Working loads are distributed to the fabric of the craft. The boat undercarriage can be manually lever-controlled and the lever anchors the undercarriage. A motorized actuator is also given. An elevated towing hitch is used with all embodiments, and includes a safety, breakaway link for highway needs. Signal/running lights are included with the small boat embodiments.

24 Claims, 11 Drawing Sheets

U.S. PATENT DOCUMENTS

| | | | |
|---|---|---|---|
| 2002/0014195 | A1 | 2/2002 | Burlet |
| 2005/0034646 | A1 | 2/2005 | Royle |
| 2006/0017246 | A1 | 1/2006 | Singer |
| 2007/0001419 | A1 | 1/2007 | Bryham |

FOREIGN PATENT DOCUMENTS

| | | |
|---|---|---|
| CA | 102287 | 12/2003 |
| CA | 2564467 | 3/2005 |
| NZ | 528471 | 8/2006 |
| WO | WO2005028300 | 3/2005 |

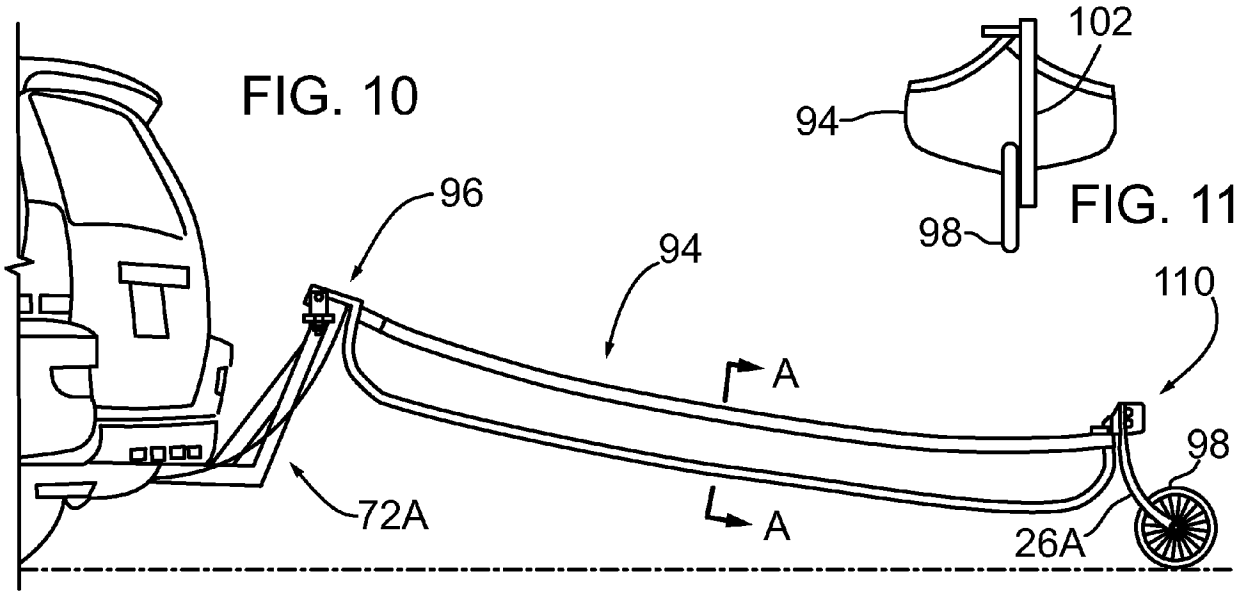
FIG. 10
FIG. 11
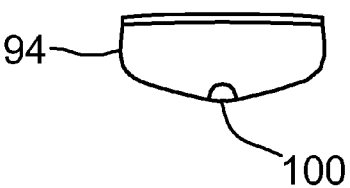
FIG. 12
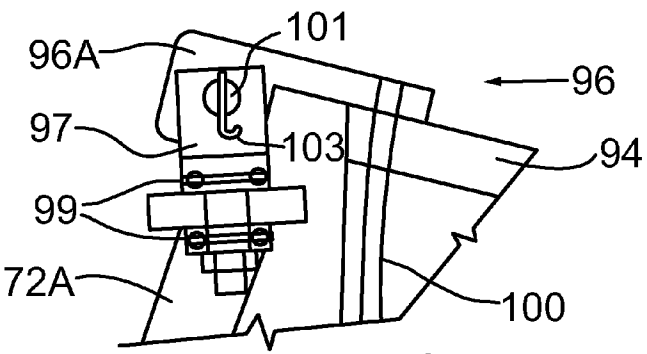
FIG. 13

AMPHIBIOUS BOATS, CANOES AND KAYAKS

RELATED APPLICATION(S)

This application is a continuation of U.S. application Ser. No. 12/379,271 filed Feb. 18, 2009, now U.S. Pat. No. 8,091,501; and this application claims the benefit of Canadian Patent application number 2,653,882, filed Feb. 12, 2009, each of which is incorporated by reference in its entirety herein.

BACKGROUND

This invention is directed to small boats equipped with retractable undercarriages, suited for being towed behind a vehicle, and for use as watercraft.

Boats in a wide range of sizes are conventionally mounted upon a trailer, for land transportation. In addition to the costs of a trailer there are a number of drawbacks to this procedure. In the case of canoes and kayaks, these also may be carried in trailers, but are frequently mounted upon the roofs of vehicles.

In the case of small powerboats with inboard or outboard motors, fishing boats, sail boats and rowboats, these additional drawbacks include: the initial mounting of the boat to the trailer, which normally requires at least two people; securing the boat to the trailer; wading the trailer in order to disembark the boat; parking the vehicle/trailer combination during the use of the boat; and reversing these procedures at termination of use of the boat. The roof-mounting of canoes and kayaks frequently requires two persons, and necessitates securely lashing the craft to the vehicle.

Many attempts have been made in the past to provide retractable undercarriages, including retractable undercarriages for small boats. However, for a wide variety of reasons, none of these earlier attempts appear to have achieved commercial success, and a practical solution to this problem does not appear to be commercially available.

One difficulty that has to be overcome, particularly in the case of small boats having lightweight aluminum hulls, is the problem of attaching undercarriage components in such a fashion as to permit trailering of the boat without distorting or damaging the hull structure. In the case of canoes and kayaks, the nature of their structures, and their inherent flexibility make them unsuited to the addition of extraneous add-on structures.

BRIEF SUMMARY OF THE INVENTION

The present invention provides an amphibious small watercraft having a hull, a towing hitch mounted at the bow of the craft, a wheeled undercarriage adjustably secured to the hull, having a first, retracted, position and a second, deployed, position; the undercarriage having a curved spring support arm with a wheel located at the end of the support arm, the arm being located in a concave-upward trailing mode when in its second, deployed position; and locking means securing the undercarriage in its second position, in use to enable vehicular towing and single-handed transfer of the watercraft.

The invention provides the small watercraft as set forth above, including reinforcement means connecting the undercarriage with the hull of the craft.

The small watercraft as set forth above, wherein the watercraft is selected from the group comprising rowing/motor/sailing boats, canoes and kayaks.

The subject small watercraft comprising a rowing/motor/sailing boat, wherein the undercarriage is a duplex undercarriage that includes two of the support arms, each having a wheel attached thereto; the locking means comprising a control lever having one end of the arm connected in torque transfer relation with the two support arms; the other end of the control lever being secured in immobilized, load transfer relation with the hull of the boat.

The subject small watercraft, being a canoe or a kayak, and having an undercarriage that consists of a single support arm and an attached wheel, the locking means including an anchor plate secured to the hull of the canoe, the plate having one end of the arm pivotally attached to it, for pivotal displacement from its first, retracted position to its second, deployed position; and abutments projecting from the plate to locate the arm in a selected one of its two positions.

The subject small watercraft, having a duplex undercarriage; wherein the torque arm is releasably secured to the boat hull, and is manually moveable from a second position securing the undercarriage in a deployed position, to a first position wherein the undercarriage is retracted from its second position to an inoperative position above the hull.

The subject small watercraft with duplex undercarriage has an option wherein the control lever is secured to the boat hull; in this option the undercarriage has a reduction gear secured by the control lever to the boat hull; wherein operation of the reduction gear in a first direction displaces the undercarriage from a second deployed position to a first retracted inoperative position above the hull, and reverse operation of the gear deploys the undercarriage. The reduction gear may be hand or motor operated.

The subject small watercraft, wherein the reduction gear is supportedly connected by a supplemental support arm to the hull of the boat, to maintain a housing portion of the reduction gear immobile during the trailering of the boat, and during the operation of the reduction gear.

The subject reduction gear, when hand-operated may include a locking pin to lock the gear operating handle, particularly when the undercarriage is deployed for trailering use, thereby locking the undercarriage in its deployed position.

Another embodiment may rely at least in part upon its reduction gear ratio being sufficiently high, in use to prevent overhauling of the gear under loads applied to the undercarriage during trailering of the boat.

The subject small boat's retractable duplex undercarriage has a pair of journal boxes mounted upon and located intermediate the ends of gunnel portions of its hull; and hull reinforcement members connecting the journal boxes to the hull in load transfer relation.

The subject small watercraft with duplex undercarriage has a towing hitch secured to the bow, with reinforcement means transferring loading forces to the hull.

For both the canoe and kayak, the undercarriage locking means includes a withdrawable abutment pin selectively attachable to the anchor plate, to immobilize the arm in abutting relation with a selected one of the abutments in a selected one of the two positions of the arm.

Also, for both the canoe and the kayak, a towing hitch located at the bow of the canoe/kayak, for attachment to a towing hitch of a vehicle, is of a polarized nature such that in use the combined vehicle/craft hitches restrict the towed watercraft from lateral toppling (tilting) displacement relative to the vehicle, permitting only relative vertical and left/right turning displacement.

For the canoes and kayaks, the hull reinforcement means consists of a unitary spine member extending from bow to stern of the craft, and following the lower profile of the hull. The towing hitch and the undercarriage are secured to the respective ends of the spine member, in load transfer relation with the hull.

In the case of the small boats, signal/running lights may be permanently attached, including a connection for attachment to the lighting system of the towing vehicle, while for canoes and kayaks a removable wiring harness and a lightweight frame for the signal/running lamps can be provided.

The subject boat undercarriage may have an intermediate axle of predetermined stiffness extending laterally across the boat securing the axle portions in mutually spaced, laterally aligned relation; the intermediate axle having a control lever projecting therefrom, in use to enable rotation of the intermediate axle, the projecting axle portions and the attached wheels from a second, secured condition wherein the wheels are deployed downwardly a predetermined distance, to extend below the boat hull; to a first, retracted condition whereat the attached wheels are in an elevated position sufficient to clear the surface of a supporting body of water on which the boat may float. The control lever may be adjustably secured to the intermediate axle, to enable it to be selectively repositioned transversely across the width of the boat.

The boat has a lever attachment fitting secured to the boat hull, for releasably immobilizing the lever when the wheels are in their second, deployed condition.

The boats also have hull reinforcement structure secured to the hull in supporting relation with the aforesaid lever attachment.

In a second aspect of the deployment/retraction provisions for the subject boat, the intermediate axle that extends laterally across the boat is connected at its centre to the gear wheel of a worm reduction gear. The gear box containing the worm/reduction gear is attached to the hull of the boat. An alternative arrangement has a pair of half axles located within the two halves of the intermediate axle, the half axles being driven by the gear wheel of the worm reduction gear; and having their outer ends attached in controlling relation with the journal box axle portions. In this alternative arrangement, the intermediate axle inner ends are secured to the side walls of the gear box.

The inner ends of the half axles are connected to a pinion wheel within a housing containing a helical worm drive. The hand-operated worm drive version has a cranked handle, the rotation of which serves to reposition the undercarriage from its deployed position to its retracted position, and vice versa. The intermediate axle and the worm drive gear box are preferably secured in a fixed position by a lever securing them to the hull of the boat, to provide the torsional force required, primarily to withstand the loads applied against the undercarriage when deployed.

In canoe and kayak embodiments the undercarriage has a single wheel, mounted at the rear of the craft, with hull bending reinforcement provided in the form of a central spine extending the length of the hull, along the craft centerline. The characteristic longitudinal flexibility of the canoe/kayak hulls is compensated for by the addition of this auxiliary, built-in spine extending along the bottom of the craft, to stiffen the craft longitudinally, while providing a rigid substructure, which enables an undercarriage with a wheel or wheels to be secured at the rear of the hull, and a towing hitch to be secured to the nose of the hull, without unduly stressing the fabric of the craft.

In all embodiments, the stability of the undercarriage is enhanced by the form of the wheel suspension arm, when deployed, as an upwardly concave flat section leaf spring, the transverse dimension of which provides tremendous stability to the axle of the supported wheel, so that wheel alignment remains true.

The boats, canoes and kayaks may also include undercarriage immobilization means secured to the craft, in use to secure the wheels/wheel in their elevated position.

For the boat embodiments this undercarriage immobilization means may comprise a toggle linkage adjustably and removably secured to the boat hull and having a movable head portion, the toggle linkage having a first, retracted condition, with the head in non-contacting relation with the undercarriage, and a second, actuated condition of the toggle linkage, with the head releasably locked in immobilizing contact with the undercarriage, when the wheels are in a fully retracted, elevated condition. For this embodiment, the toggle immobilization means may also include an outboard platform portion to receive a portion of the undercarriage in supported relation thereon.

For the canoe/kayak embodiments, the undercarriage arm with its attached wheel may be readily removed, for storage such as in the towing vehicle, or elsewhere.

For the canoe and kayak embodiments, the hitch connecting the craft to the towing vehicle is 'polarized', so as to permit the craft only pivotal up-and-down displacement.

In the preferred embodiment, this 'polarized' hitch is a simple pinned arrangement, having a horizontally oriented pin that inhibits lateral canting of the craft.

While the preferred mode of trailering a boat is bow-first, it will be understood that the reverse may apply, within the ambit of the present invention.

BRIEF DESCRIPTION OF THE SEVERAL VIEWS OF THE DRAWINGS

Certain embodiments of the invention are illustrated, by way of example, without limitation of the invention thereto, other than as set forth in the accompanying claims; it being understood that further embodiments may be derived by one skilled in the art. Reference is made to the accompanying drawings, wherein:

FIG. 10 is a side view of a subject canoe embodiment in accordance with the present invention secured by an elevated hitch to a towing vehicle, with the canoe undercarriage deployed;

FIG. 11 is a rear-end view of the canoe of FIG. 10;

FIG. 12 is a mid-length cross section of the canoe hull showing its inbuilt auxiliary spine;

FIG. 13 is an enlarged side view of a portion of FIG. 10, showing details of the vehicle towing hitch and the canoe/kayak hitch attachment;

DETAILED DESCRIPTION OF THE INVENTION

Figure 1:
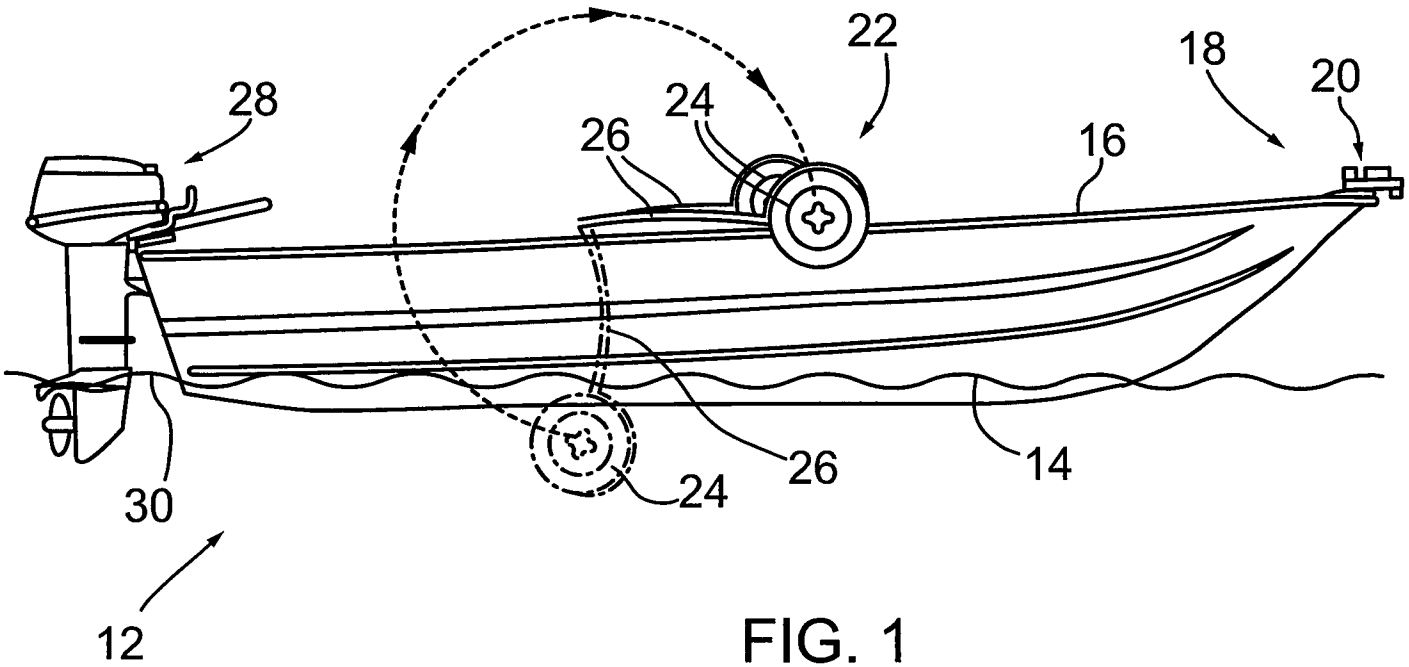
FIG. 1 is a side view of a subject amphibious boat afloat, showing retracted and deployed positions of the undercarriage.
Figure 2:
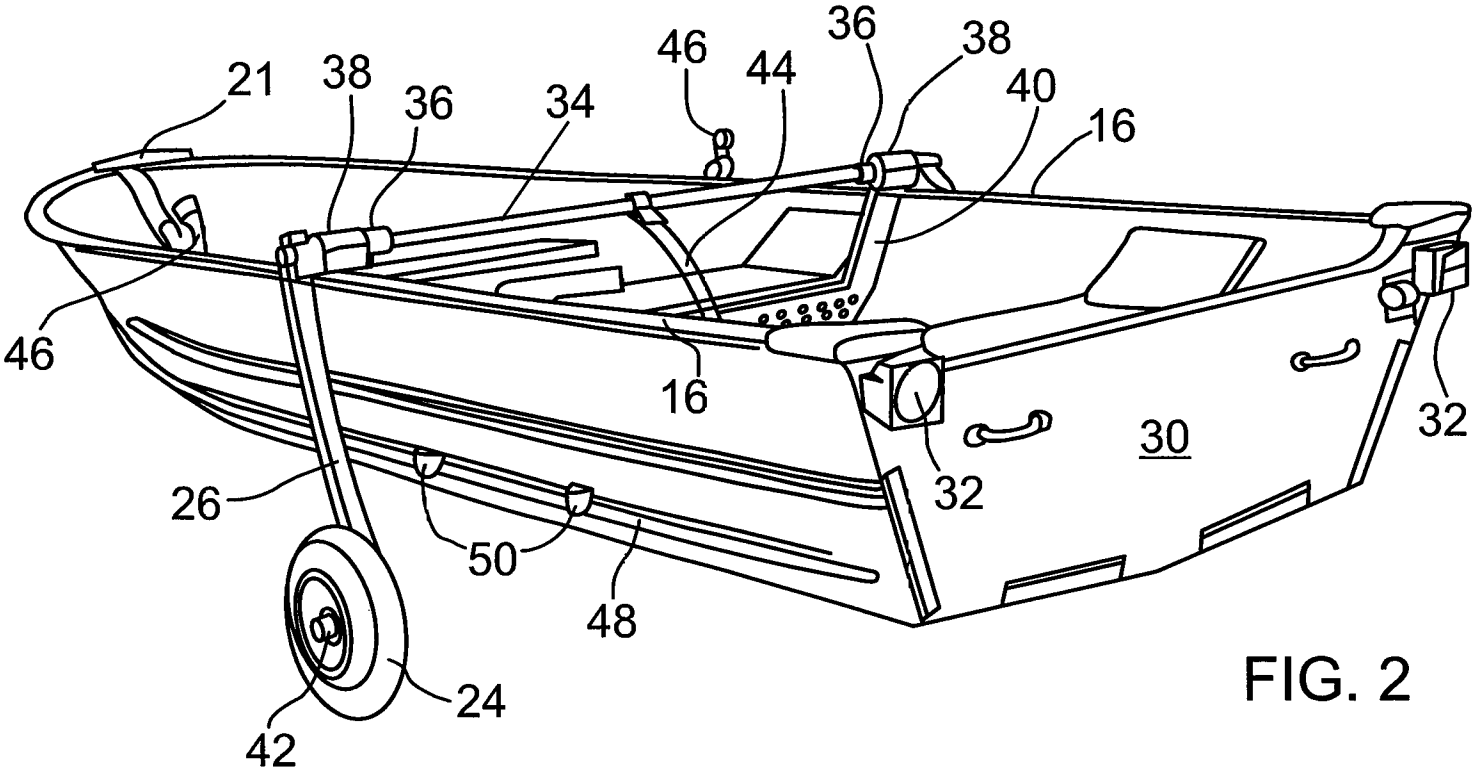
FIG. 2 is a three-quarter perspective view, at the stern end of a subject boat, with the undercarriage deployed.
Figure 3:
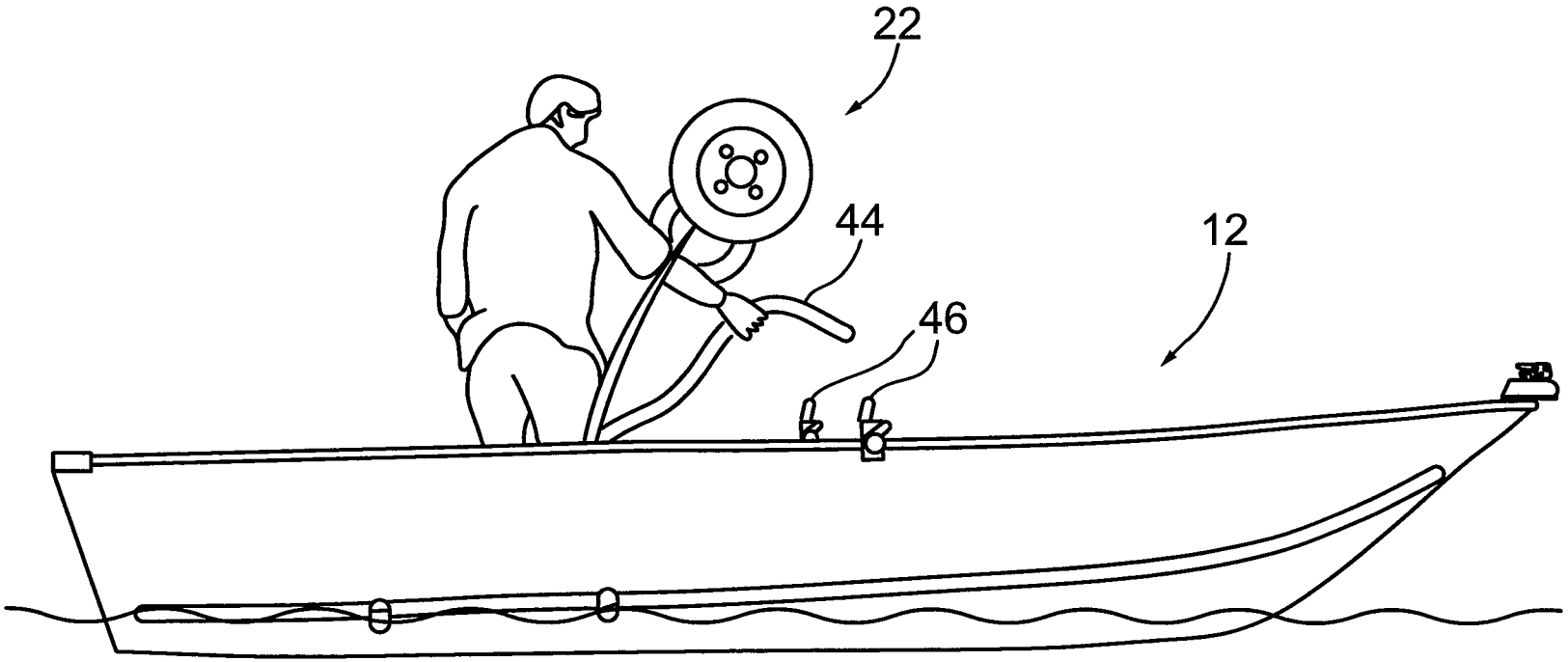
FIG. 3 is a side view of a subject boat afloat, having the undercarriage partially retracted.

Referring to FIGS. 1, 2 and 3, a small boat 12 of the type used for rowing, fishing or use with an outboard motor, has a hull 14 with gunnels 16 extending along the two sides of the hull 14. At the bow 18 a towing hitch 20 is secured, mounted on plate 21 that forms part of a bow reinforcement structure (FIG. 2). Attached at midships is a retractable undercarriage 22 having wheels 24 mounted upon wheel support arms in the form of spring steel trailing support arms 26 having an oblong cross-section, curved concave-upward.

It will be understood that the boat illustrated is of the sheet aluminum type.

In FIG. 1 the undercarriage 22 is shown in its fully retracted position, with its deployed position illustrated in phantom. FIG. 1 also shows the boat 12 with an outboard motor 28 attached to its transom 30.

In the FIG. 2 embodiment, traffic lights 32 are shown, mounted on the transom 30. A wiring harness (not shown) extends the length of the boat to a plug-in connection 33 located at the bow (see FIG. 6), for connection of the boat lights to the signal/lighting system of a towing vehicle.

The undercarriage 22 has an intermediate axle 34 located in the boat mid section and extending laterally at right angles to the boat's longitudinal axis (not shown). This intermediate axle 34 interconnects two axle portions 36 that are rotatably secured in journal boxes 38 that are transversely mounted upon the gunnels 16.

A hull reinforcement includes web 40, to which the journal boxes 38 are attached, and which reinforcement with web 40 distributes to the boat hull 14 a significant portion of the undercarriage loading forces acting on the journal boxes 38.

The axle portions 36 extend outboard, beyond the boat hull 14, and have the undercarriage arms 26 of spring steel secured thereto.

A stub axle 42 secured to the remote, distal end of each arm 26 projects outwardly (away from the boat), each stub axle 42 having a wheel 24 rotatably mounted thereon.

An undercarriage control lever 44 is attached to the intermediate axle 34, the control lever 44 being illustrated as being located centrally upon the axle 34.

Also shown are a pair of undercarriage immobilization toggle clamps 46, mounted upon gunnels 16 and located forward of the journal boxes 38. The clamps are adjustably/removably mounted to the gunnels.

Figure 4A:
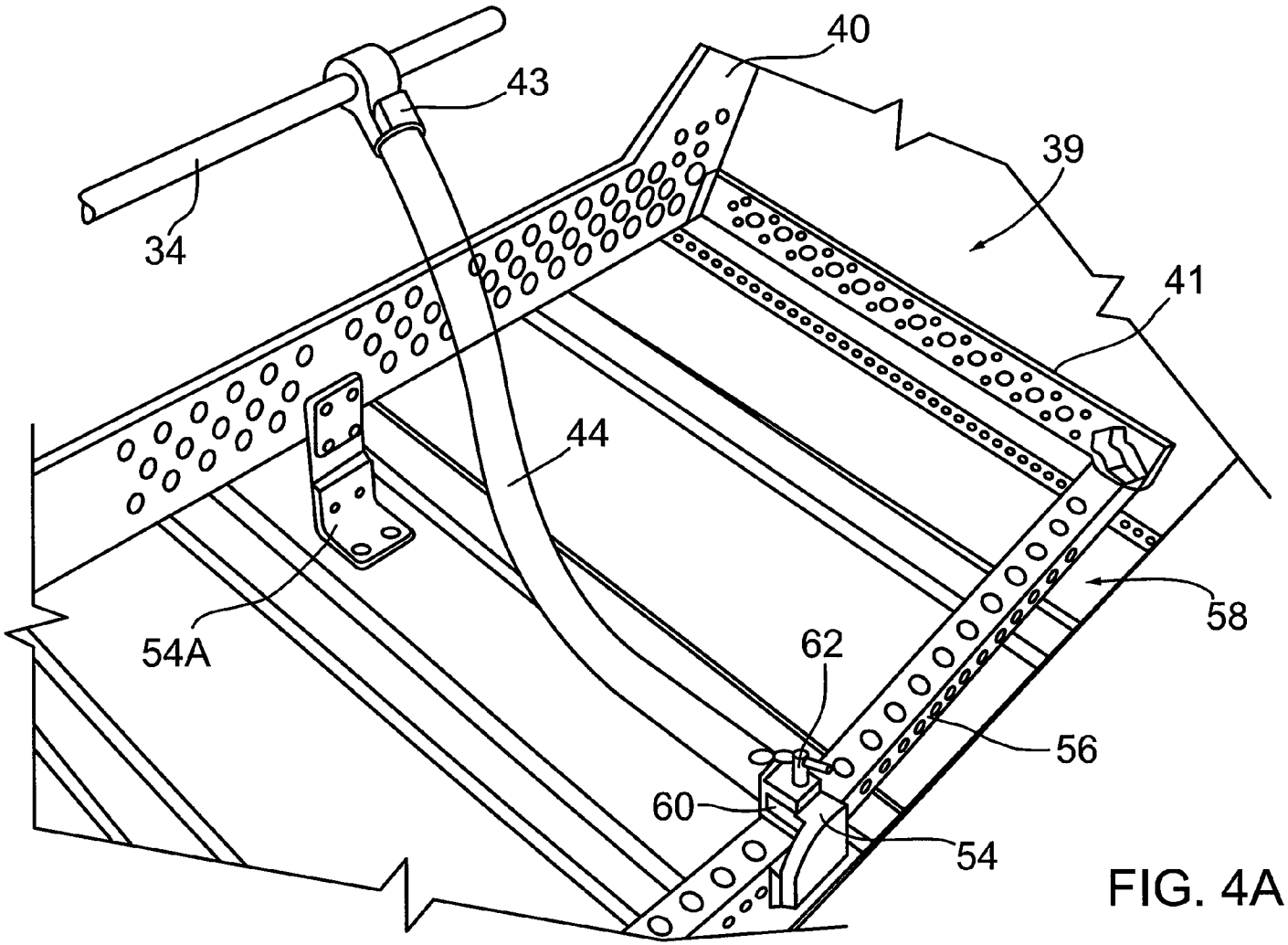
FIG. 4A is a localized view, in perspective, showing the control lever locked for the undercarriage deployed condition.

On a hull strake 48 on each side of the boat 12 are located two strong points 50, to which the hull reinforcement 39 that includes web 40, is bolted (see FIG. 4A). Two additional strong points are positioned along the keel section, longitudinally coincident with the hull reinforcement 39, of which web 40 forms a part.

In FIGS. 1 and 3 a boat 12 is shown afloat, FIG. 3 demonstrating undercarriage retraction when the boat 12 is afloat, where the occupant of the boat can readily unlock and raise the undercarriage control lever 44 to raise the undercarriage 22 from its deployed condition to its retracted, stowed position.

In use, the undercarriage may remain deployed during initial operations in water, to safeguard an outboard motor from bottoming damage in shallow water or rocky beach.

The toggle clamps 46, 46 are shown in their retracted condition.

In the fully retracted position of the undercarriage 22, the end of the control lever 44 is positioned pointing downward and located closely adjacent to the bottom of the boat, to position the wheels 24 in their illustrated retracted condition.

In this position of the undercarriage 22, one or both of the toggle clamps 46 may be actuated, to bring the moveable heads of clamps 46 outboard and down in releasable clamping relation with the undercarriage 22. This precludes accidental deployment of the undercarriage 22 when the boat is underway. The end of control lever 44 may also be secured to the hull of the boat 12 for that purpose.

Referring to FIG. 4A, this partial (scrap) view shows the control lever 44 in its rearward, clamped condition, securing the undercarriage 22 (not shown) in its fully deployed condition (see FIG. 2), with the wheels deployed to make ground contact. The control lever 44 provides torque to counter those forces acting on the undercarriage 22 when it is supporting the weight of the boat and its contents, including impact forces acting on the undercarriage when the boat is being trailered.

When afloat in shallow water the partial support of the boat by the still-deployed undercarriage 22 can serve to keep the propeller of an outboard motor from grounding or fouling on small rocks etc.

The control lever 44 is anchored by way of an angle bracket 54, secured to the rearward face 56 of a reinforcing cross tube 58 that forms part of the hull reinforcement structure 39, of which web 40 and brace 41 also form a part.

As stated above, the hull reinforcement 39 is through-bolted in place to four strong points 50 on the hull, at the hull strakes 48 (see FIG. 2) and two strong points, outboard along the keel, beneath brackets 54 and 54A, and serves to safely distribute boat/boat load and trailering forces that may act upon the undercarriage 22, when the undercarriage is deployed.

It will be noted that the reinforcement parts 40, 41 and 58 are perforated for weight saving and for drainage purposes, to minimize pooling in the bottom of the boat.

A tongue portion 60 of control lever 44 is entered beneath angle bracket 54, and secured in place by control lever pin 62. A slight transverse flexing of the lever 44 enables the tongue portion 60 to be inserted beneath the angle bracket 54, for insertion of the pin 62 in interlocking, securing engagement therewith.

Figures 4B, 4C, 4D:
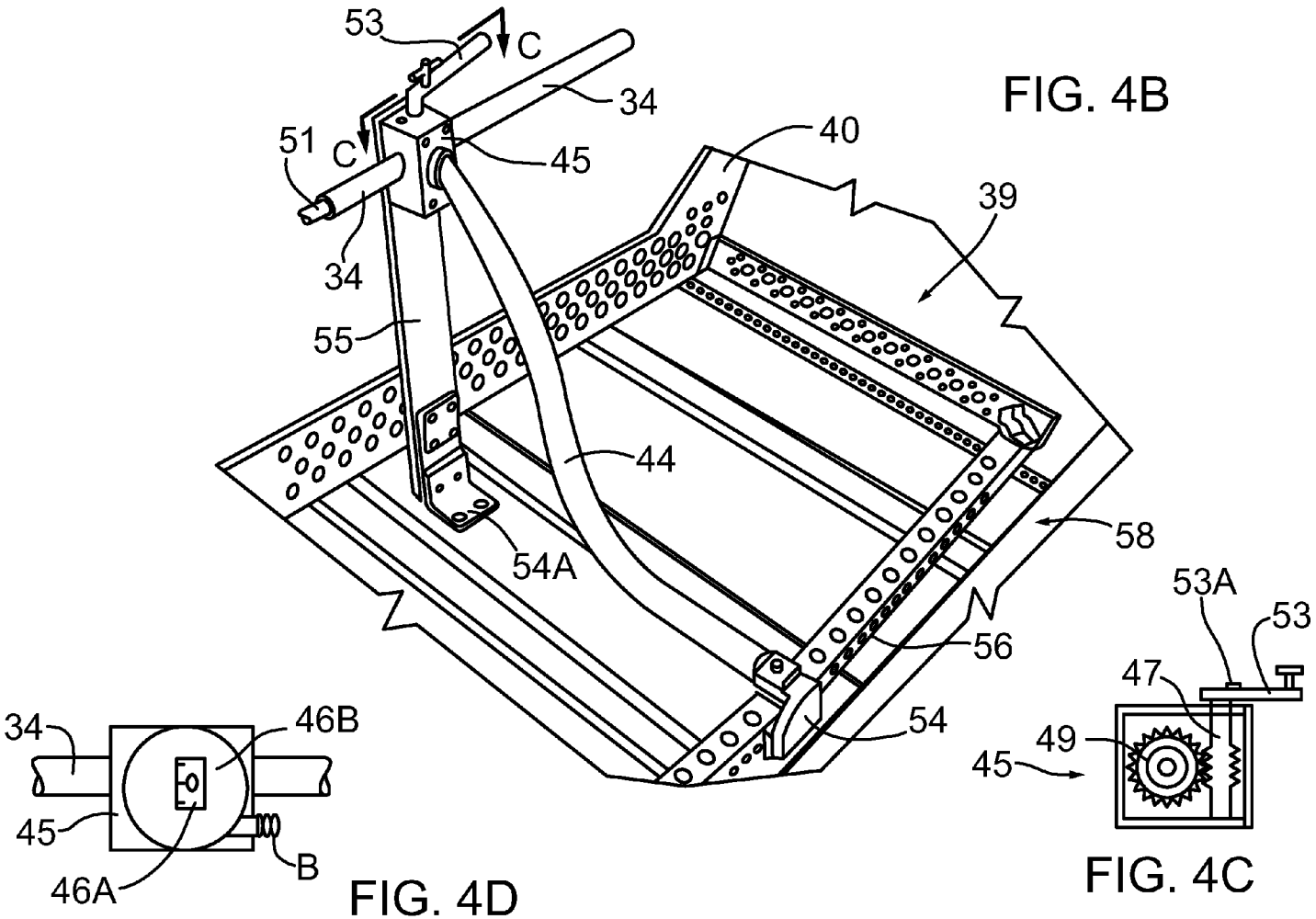
FIG. 4B is a view similar to FIG. 4A of a further embodiment having a hand-cranked worm gear undercarriage retraction mechanism.
FIG. 4C is a section view of the worm-gear gear box, taken at C-C of FIG. 4B.
FIG. 4D is a plan view of a motor-driven worm-gear box.

In the FIG. 4B embodiment the manual deployment and retraction of the undercarriage 22 is effected by a reduction gear 45. The manual gear 45 (FIG. 4C) has a worm 47 and pinion wheel 49, to which axle portions 36 are connected by half axles 51 located within the intermediate axle 34. In this arrangement the two halves of the intermediate axle 34 are secured to the housing side walls of the reduction gear 45. The half axles 51 are keyed to the pinion wheel 49.

A crank 53 is used to manually drive the worm gear 47, and has a locking pin 53A to secure it in position, when the undercarriage is deployed or retracted.

In the FIG. 4D power-driven embodiment, a battery-driven electric motor 46B is mounted upon the reduction gear 45, being controlled by a three-position switch 46A, illustrated as 'D' (DEPLOY), 'O' (OFF) and 'R' (RETRACT). A cylindrical rechargeable battery B is readily withdrawn and safely pocketable, to positively immobilize the gearbox 45 during trailering, so as to prevent accidental undercarriage retraction.

Alternatively, the intermediate axle 34 may itself be keyed to, and driven by the pinion wheel 49; the axle 34 being supported in bearings in the housing side walls of reduction gear 45.

In the case of the reduction gear embodiments, the control lever 44 is used as a fixed torsion arm, to counter the turning moments (both clockwise and counterclockwise) that act upon the reduction gear, both in its displacement of the undercarriage 22, and when the undercarriage 22 is deployed and supports the weight of the boat and its contents.

A supplemental support arm 55 is also illustrated, secured by bracket 54A to the exterior keel strong points (not shown) to minimize the bending moments acting on the reduction gear 45 and its attached axle components, detailed above.

Figure 5:
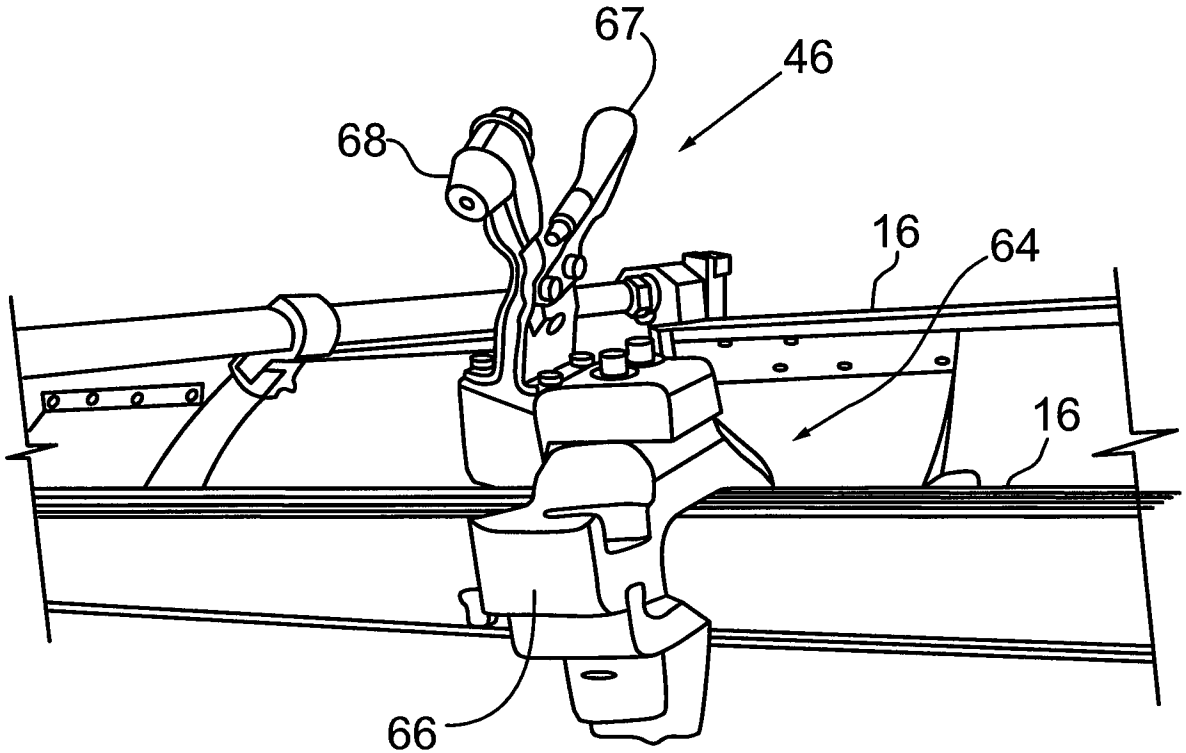
FIG. 5 is a side perspective view of a toggle link clamp for the retracted undercarriage.

Turning to FIG. 5, a toggle clamp 46 is shown bolted down to a composite bracket assembly 64 which enables clamp 46 to be readily relocated along the gunnel, or removed.

The toggle clamp 46 is shown in its deactivated condition, having its elastomeric head portion 68 raised above and inboard of the gunnel 16.

The component parts of bracket assembly 64 are bolted together in sandwiching relation with the gunnels 16, and the assembly 64 includes an outboard platform portion 66.

The platform portion 66 receives a distal end portion of the undercarriage 22, namely the end of support arm 26, and stub axle 42, in supported relation thereon, when the undercarriage is fully retracted.

The bracket assembly 64 serves to distribute and harmlessly transfer to the hull of the boat the weight of the retracted undercarriage 22 and those forces acting upon the toggle clamp 46.

At this juncture the inboard handle 67 of toggle clamp 46 is depressed, swinging the elastomeric head portion 68 outboard and down onto the undercarriage, immobilizing the undercarriage and holding it down onto the bracket platform portion 66.

It will be understood that with the undercarriage fully retracted, and the control lever 44 in its forward position, immobilization may also be achieved by tying down or otherwise immobilizing control lever 44.

Figure 6:
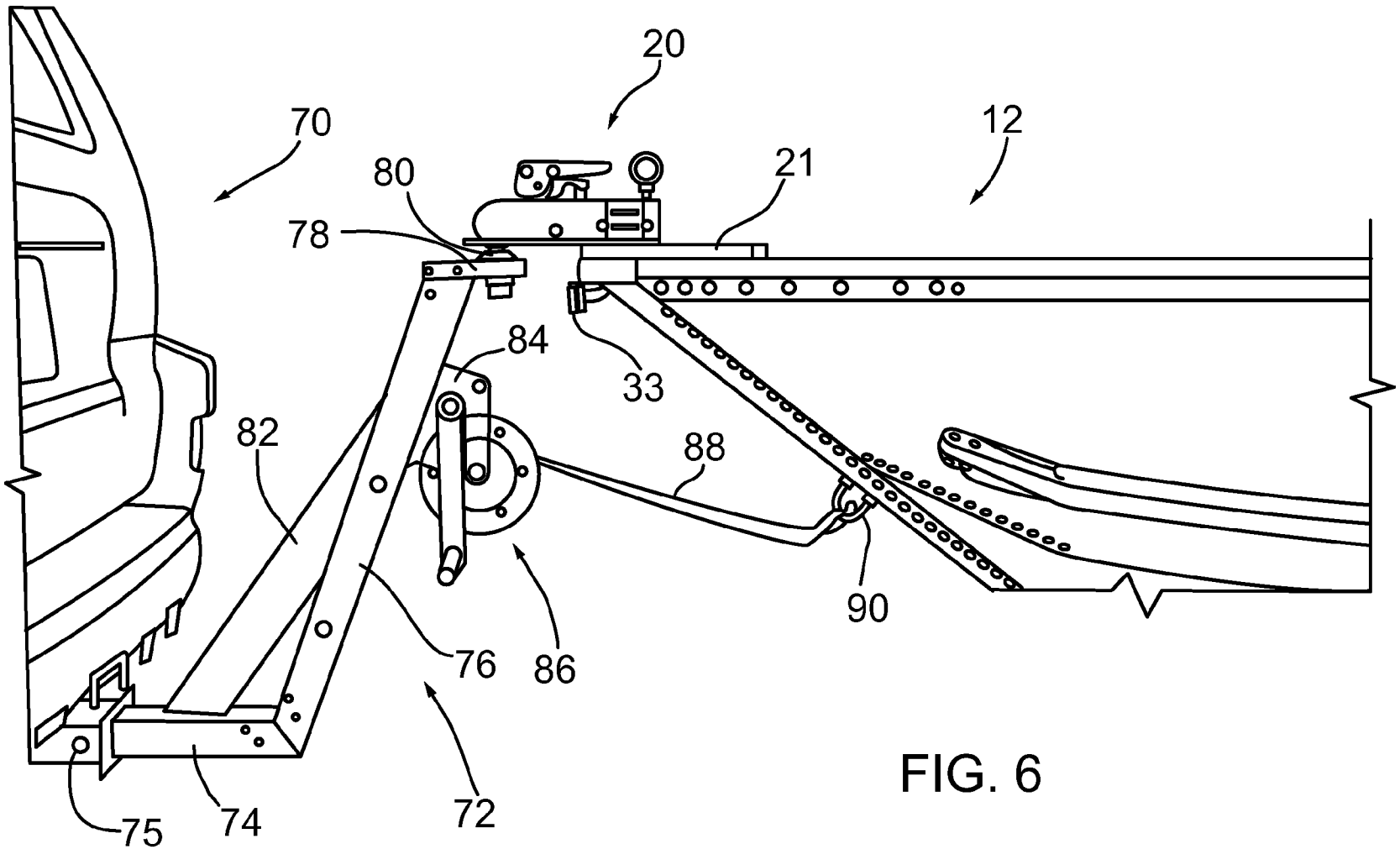
FIG. 6 is a side view of a towing vehicle with a subject towing hitch, and the bow portion of a subject amphibious boat.

FIG. 6 shows a bow portion of a rowing/fishing/sailing/outboard type boat 12, the boat 12 being hitched to the back 70 of a towing vehicle, by way of an elevated vehicle hitch 72, to which the towing hitch 20 (of boat) is secured.

The reinforcement plate 21 (see also FIG. 2), connects the towing hitch 20 (of boat) to the boat bow, in load dispersive relation.

Figure 9:
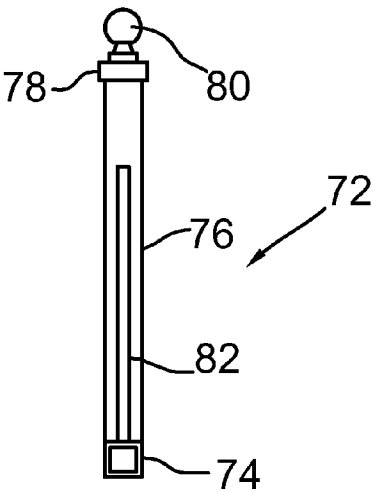
FIGS. 7, 8 and 9 are respectively side, plan and end views of a subject elevated towing hitch for the subject amphibious boats.
Figure 7:
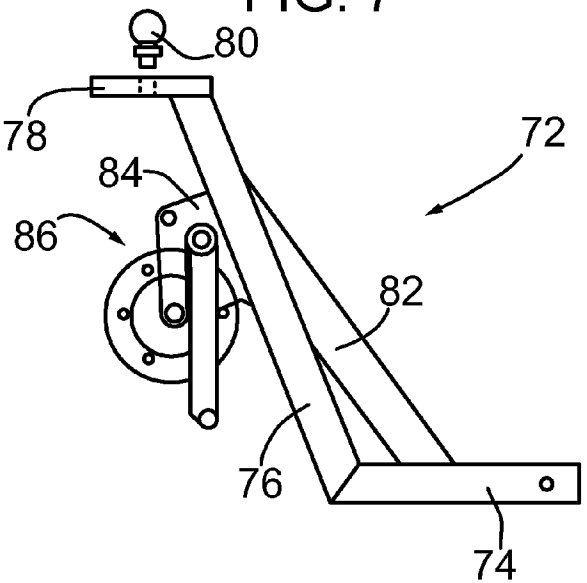
Figure 8:
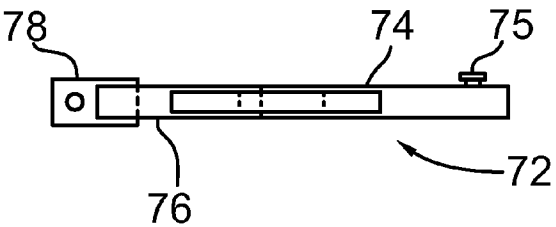

Turning also to FIGS. 7, 8 and 9, the elevated vehicle hitch 72 has a hollow base member 74 of square section that is sized for insertion as the male member within the towing tube of a heavy-duty vehicular towing hitch, being secured in entered, pinned relation to that hitch by way of hitch pin 75 (FIG. 8).

The elevated vehicle hitch 72 has an inclined mast portion 76 of square section, welded to the base member 74, and having a platform portion 78 surmounted by a hitch ball 80 bolted to platform 78. The mast portion 76 has an inclined brace member 82 welded to it, the bottom end portion of brace member 82 being welded to the top surface of base member 74.

A rearwardly extending plate 84 supports a windlass 86 (FIGS. 6 and 7). A windlass cable 88 is secured by way of a spring-loaded catch to an eye 90, attached to the bow of the boat 12. The windlass 86 serves in handling the boat 12, as in winding it up/down a slipway or loading ramp; and in its fully retracted condition the windlass 86 and cable 88 serve as an emergency tether, to meet highway safety requirements, when being trailered.

The high gearing ratio of the windlass 86 (and its somewhat low efficiency) prevents the cable 88 from overhauling the windlass, in the event of a towing breakaway of the boat from its hitch.

Turning to FIGS. 10 to 13, a canoe 94 is attached by a hitch 96 located on the bow of the canoe to an elevated vehicle hitch 72A attached to a towing vehicle. The elevated vehicle hitch 72A has an upstanding bifurcated hitch post 97 rotatably mounted upon bearings 99 that permit free total rotation of the hitch post 97, while precluding any tilting of the post 97, relative to the elevated vehicle hitch 72A and its vehicle.

The canoe/kayak towing hitch 96 is welded to the spine 100/112 of the craft, the craft spine 100 being integrally moulded into the hull of the canoe (as is also the case for the kayak).

The towing hitch 96 (of canoe/kayak) with its vertical sides 96A is a close sliding fit within the vertical slot of bifurcated hitch post 97, to substantially preclude lateral tilting of the canoe 94 or kayak 111 in relation to the elevated vehicle hitch 72A.

The towing hitch 96 is pinned to elevated vehicle hitch 72A by a withdrawable, horizontal pin 101, giving the towing hitch 96 limited freedom to pivot vertically, up and down, the horizontal pin 101 being secured by a cotter pin 103. The vertical pivoting motion accommodates changes in elevation and climbing/descending attitude between the towing vehicle and the trailered canoe/kayak craft.

The flat, vertical sides 96A of the towing hitch 96 and the vertical slot of the bifurcated hitch post 97 serve to 'polarize' the towing hitch (of boat) in a vertical plane, to permit changes in elevation between the towing vehicle and the canoe, while the rotatable, bifurcated hitch post 97 of elevated vehicle hitch 72A ensures tracking of the canoe behind its towing vehicle, while the 'polarization' of the hitch prevents any lateral, capsize movement of the canoe 94 upon its hitch, thereby maintaining the plane of wheel 98 substantially parallel with the plane of the wheels of the towing vehicle.

The spine 100, 112 of aluminum tube, common to both canoe 94 and kayak 111, is moulded in the fabric of the hull of the craft (see FIG. 12), and extends from bow to stern of the respective craft 94, 111 being shown in phantom in FIG. 10 and a bow portion in FIG. 13. It will be understood that alternative forms of craft stiffening may be adopted.

In FIG. 11 a detachable stainless steel tether wire 102 connects the wheel 98 to the hull of the canoe 94, in order to meet highway safety requirements. A similar provision is made in the case of the kayak 111.

Figure 14:
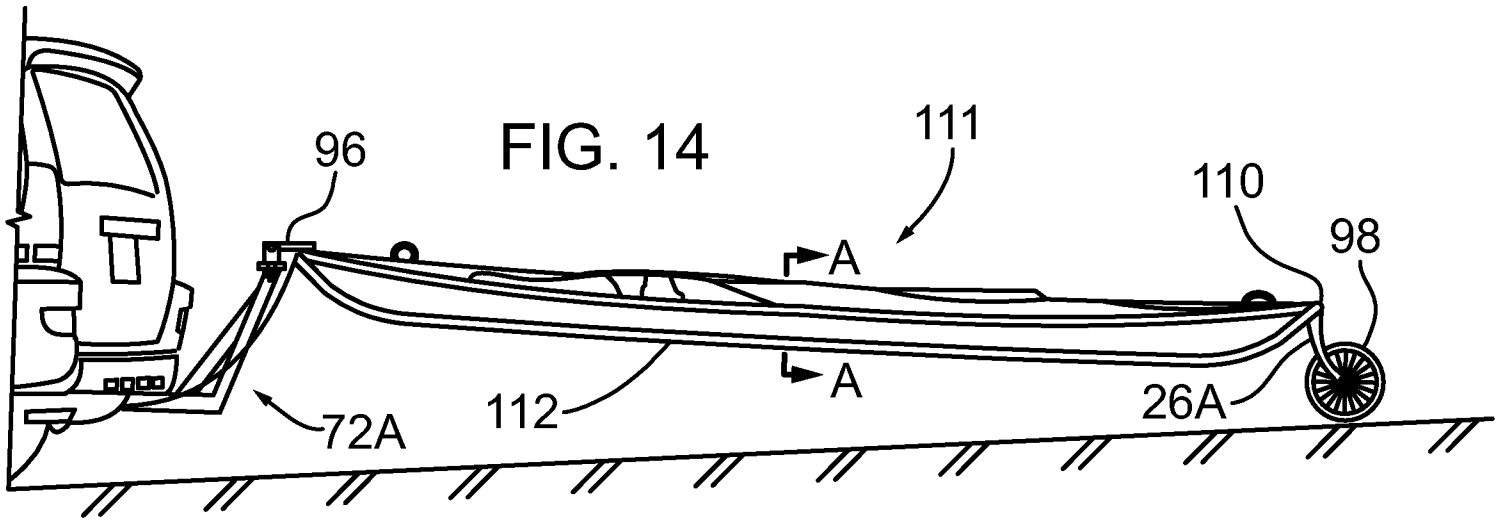
FIG. 14 is a side view of a subject kayak embodiment in accordance with the present invention secured by an elevated hitch to a towing vehicle, with the kayak undercarriage deployed.

FIG. 14 shows a kayak 111 in accordance with the present invention, having a stiff 'spine' 112 of aluminum tube moulded in the fabric of its hull (see FIG. 16), which spine 112 extends from bow to stern of the kayak 111, being shown in phantom in FIG. 14.

In the case of both kayak 111 and canoe 94, the two spine ends both protrude upwardly above the fabric of the craft, and have elements of the hitch (at the bow) and the undercarriage (at the stern) attached to the respective protruding spine portions, so as to transfer the associated loadings in dispersed relation to the fabric of the craft. It will be understood that due to the substantial longitudinal symmetry of the respective craft "bow" and "stern" may be readily interchanged.

The provisions for mounting and locking in place the support arm 26A and wheel 98 that comprise the kayak 111 undercarriage are substantially the same as for the canoe 94, (see below re FIGS. 17, 18 and 19), together with the stainless steel (safety) tether cable 102, as detailed above.

Figure 15:
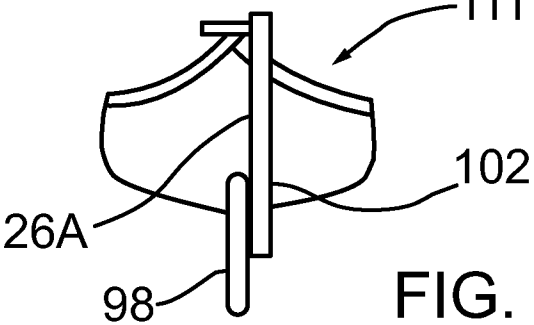
FIG. 15 is a rear-end view of the kayak of FIG. 14.

FIG. 15 shows the kayak 111 having the wheel 98 and support arm 26A in the deployed condition.

Figure 16:
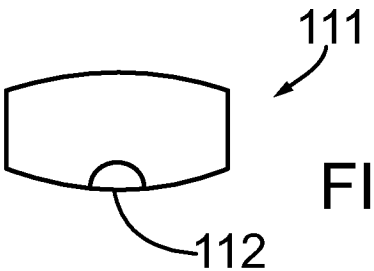
FIG. 16 is a mid-length cross section of the kayak hull, taken at A-A of FIG. 14 showing its inbuilt auxiliary spine.

FIG. 16 shows the tubular aluminum spine 112 integrated into the fabric of the kayak 111.

Figure 19:
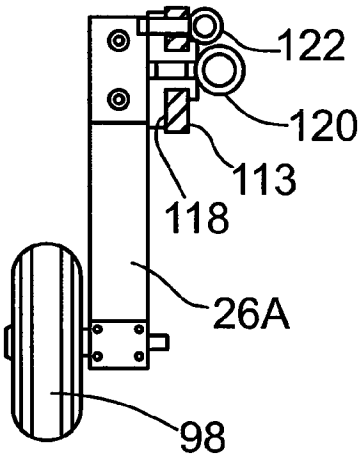
Figure 17:
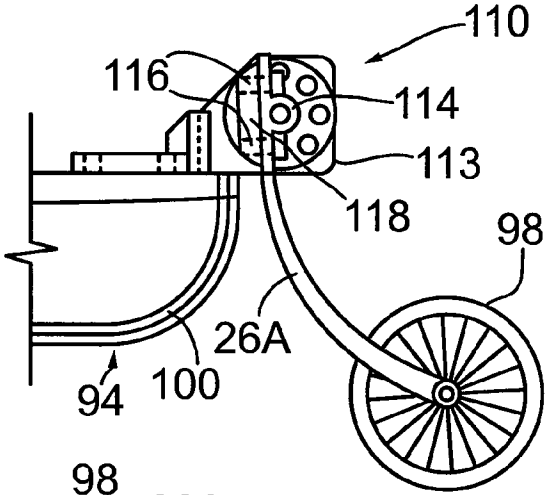
FIG. 17 is an enlarged view of the undercarriage portion of FIG. 10.
Figure 18:
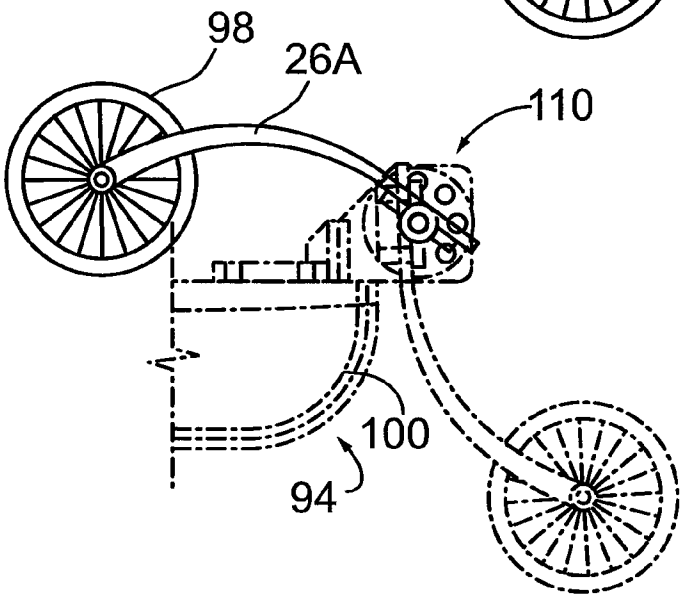
FIG. 18 is similar to FIG. 17, including the undercarriage in its retracted position; and, FIG. 19 is a rear-end view of the undercarriage portions of FIG. 17.

Turning to FIGS. 17, 18 and 19 it will be noted that, while illustrating the undercarriage and mounts for a canoe 94, the same principles apply for a kayak 111, although dimensions and proportions may vary.

In FIG. 17 the aft end a canoe 94 with an imbedded spine 100 has an undercarriage mounting plate 113 welded thereto (shown cross-hatched in FIG. 19, for clarity).

The curved (concavely upward when deployed) support arm 26A is bolted by bolts 116 (FIG. 17) to a base plate 118 that is secured to the mounting plate 113.

A pivot eye-bolt 120 secures the base plate 118 to the mounting plate 113, in pivotal relation therewith. Use of an eye-bolt 120 greatly facilitates removal of the support arm/wheel 26A/98 assembly.

A removable sheer pin 122 (FIG. 19) secures the base plate 118 and attached support arm 26A in the illustrated deployed position (FIG. 17) or in its upward, retracted position (with support arm 26A shown 'solid') in FIG. 18.

By removing the sheer pin 122 and the pivot eye-bolt 120, the wheel 98, the support arm 26A, along with base plate 118 can all be readily and rapidly removed from the craft, for storage elsewhere, such as in the towing vehicle.

It should be noted that there are a number of unobvious advantages to providing an amphibious watercraft with a trailing undercarriage having upwardly concave curved wheel attachment arms of predetermined flexibility. When under tow, the occurrence of a major impact with a road obstacle or pothole can only result in flexure of the boat suspension, with little tendency for the undercarriage curved arm to act as a rigid strut that could transmit serious impact damage to the hull of the craft, at the undercarriage attachment point/points.

When backing-up a craft behind a vehicle, the upwardly concave curved flexible arm is capable of flexure, if the wheel encounters a serious obstacle, and is much less likely to cause damage to the craft than would a straight trailing link arrangement that could act as a rigid strut, with disastrous consequences for the craft.

Also, in the case of a boat attached to a towing hitch of a parked vehicle and inundated by rainwater under storm conditions, filling of the boat at a rate greater than the stern drain can handle can result in the undercarriage 'kneeling' to the point where the stern becomes supported on the ground, and the transference of loading to the boat hull from the undercarriage becomes stable, as the hull per se assumes much of the dead-load of the boat and its contents, while the undercarriage serves to relieve some of the deadload from off the hitch.

The resilience of the undercarriage suspension, in the case of the fishing boat embodiment, includes the flexibility of the trailing support arms 26, together with the torsional flexure of the intermediate axle, and the bending flexibility of the control lever, all of which flexibilities contribute to the total flexure energy capacity of the undercarriage and its securement system, and the durability of the total system.

In the case of the canoe and kayak embodiments, the use of a plate spring trailing arm suspension affords resilience and great lateral stability, while the incorporation of an inbuilt spine, that enables the craft to be trailered with fore and aft suspensions, has virtually no effect on the dynamics of handling in the water, and the curved trailing spring arm and 'polarized' hitch ensures secure trailing characteristics, while the low mass of the undercarriage has little effect on normal handling of the craft on the water.

It should also be noted that the subject amphibious boat, canoe and kayak embodiments are suited for operation by a single individual, and do not require undue strength in order to make full use of all their functions.

The invention claimed is:

1. An amphibious small watercraft comprising:

a hull, a towing hitch secured to the hull, a wheeled undercarriage adjustably secured to said hull, said wheeled undercarriage having a first retracted position and a second deployed position, said wheeled undercarriage including at least one support arm at least partially horizontally outboard of said hull and supporting at least one wheel at a distal end of said at least one support arm, and wherein an opposite end of said at least one support arm is pivotally attached relative to said hull along an axis substantially perpendicular to a centerline of a length of the watercraft and substantially parallel to ground over which the watercraft is to be vehicularly towed for moving the wheeled undercarriage from said first retracted position to said second deployed position, and from said second deployed position to said first retracted position.

2. The watercraft of claim 1 wherein in said second deployed position said wheeled undercarriage is deployed downwardly a predetermined distance to extend below said boat hull for vehicular towing and in said first retracted position said at least one wheel is in an elevated position sufficient to clear the surface of a body of water for marine use.

3. The watercraft of claim 2 further comprising locking means for securing said wheeled undercarriage in said second deployed position for enabling said vehicular towing.

4. The watercraft of claim 3 further comprising undercarriage immobilization means for securing said undercarriage in said first retracted position for enabling marine use.

5. The watercraft of claim 3 wherein the wheeled undercarriage is a duplex undercarriage including two said support arms, each said support arm supporting at least one said wheel.

6. The watercraft of claim 5 further comprising means for moving the wheeled undercarriage from said first retracted position to said second deployed position, and from said second deployed position to said first retracted position.

7. The watercraft of claim 6 wherein the means for moving the wheeled undercarriage comprises a control lever.

8. The watercraft of claim 6 wherein the means for moving the wheeled undercarriage comprises a gear box.

9. The watercraft of claim 8 wherein the gearbox is manually operated or power operated.

10. The watercraft of claim 5 wherein said watercraft further comprises reinforcement means for attaching the towing hitch to the hull and reinforcement means for attaching the wheeled undercarriage to the hull.

11. The watercraft of claim 10 wherein the towing hitch is attached to the bow of the hull and the wheeled undercarriage is attached to the hull intermediate the bow and the stern of the watercraft.

12. The watercraft of claim 5 wherein the watercraft comprises a row boat, a fishing boat, a motor boat, or a sail boat.

13. The watercraft of claim 5 wherein the watercraft comprises a canoe or kayak.

14. The watercraft of claim 3 wherein the watercraft comprises a canoe or a kayak.

15. The watercraft of claim 14 wherein the wheeled undercarriage comprises one support arm, said support arm supporting said at least one wheel.

16. The watercraft of claim 15 wherein and said towing hitch and said elevated vehicle hitch are polarized for preventing lateral tilting of the watercraft.

17. The watercraft of claim 16 further comprising undercarriage immobilization means for securing said wheeled undercarriage in said first retracted position for marine use.

18. The watercraft of claim 15 wherein the said support arm is removable.

19. The watercraft of claim 14 wherein said watercraft further comprises hull reinforcement means for attaching said towing hitch to the hull and attaching said wheeled undercarriage to said hull.

20. The watercraft of claim 18 wherein said hull reinforcement means comprises a unitary spine member extending from bow to stern of said watercraft and following a lower profile of said hull.

21. The watercraft of claim 20 wherein the spine member extends along the centerline of the length of the watercraft.

22. The watercraft of claim 21 wherein said towing hitch and said wheeled undercarriage are secured to the respective ends of said spine member.

23. The watercraft of claim 22 wherein said towing hitch is secured to the bow and said wheeled undercarriage is secured to the stern.

24. The watercraft of claim 22 wherein said towing hitch is secured to the stern and said wheeled undercarriage is secured to the bow.

* * * * *